US005203564A

United States Patent [19]

Bruzas et al.

[11] Patent Number: 5,203,564

[45] Date of Patent: Apr. 20, 1993

[54] METHODOLOGY BOARD FOR SELECTING GAMING NUMBERS

[75] Inventors: Carl J. Bruzas, Enumclaw; Bryant V. Rutherford, Maple Valley, both of Wash.

[73] Assignee: Carl J. Bruzas, Enumclaw, Wash.

[21] Appl. No.: 711,159

[22] Filed: Jun. 6, 1991

[51] Int. Cl.[5] ..... A63B 9/00

[52] U.S. Cl. ..... 273/161; 273/139

[58] Field of Search ..... 273/161, 138 R, 139; 434/106

[56] References Cited

U.S. PATENT DOCUMENTS 546,299 9/1895 Campbell ..... 273/161

1,095,227 5/1914 Phillips ..... 273/161

*Primary Examiner*—William H. Grieb

*Attorney, Agent, or Firm*—Bruce A. Kaser

[57] ABSTRACT

The disclosed invention is a methodology device for use in picking gaming numbers and telling fortunes. The device consists of a board surface and a pointer device. The board surface has a plurality of mystic symbols surrounded by a first circular field of numbers that is further surrounded by a ring field of I-Ching hexagrams. The I-Ching field is still further surrounded by a second number field made up of alternating odd and even numbers displayed on an alternating color pattern. Placement of the pointer device on the board surface causes it to indicate certain numbers in the first or second number fields, and certain hexagrams of the I-Ching. The user may use such items in the selection of lottery or other gaming numbers, or for fortune-telling purposes.

12 Claims, 7 Drawing Sheets

METHODOLOGY BOARD FOR SELECTING GAMING NUMBERS

DESCRIPTION

1. Technical Field

This invention generally relates to novelty devices for selecting numbers and telling fortunes, and to game board devices for leisure time activities.

2. Background Information

No one knows how or why gaming has become such an important part of human society. Some have speculated that gaming originally came into being when the human social order began to evolve past the hunter and gatherer stage of prehistory. At such time, man became less nomadic, and established semi-permanent or permanent communities. He also became less preoccupied with the basics of survival, because food and other necessities were easier to obtain with the emergence of Primitive agriculture, and the domestication of animals. As a result, man had more time to devote to satisfying his curiosity about nature and his environment. On the one hand, this created time for invention and technological development, but on the other hand, it also led to the creation of leisure time.

Some have speculated that the creation of leisure time directly led to the development of games as a way for man to entertain himself. Others have speculated that man's infatuation with games goes beyond a mere desire for entertainment or otherwise occupying leisure time, but is in some way related to man's relationship with the cosmos.

Although there may be some dispute as to why we play games, there can be no dispute that man enjoys and expends a great deal of time playing games. Many games have elements of both skill and luck, and have a definite purpose or goal that is linked to some form of competitive spirit, where there is both a victor and vanquished. Athletic events, chess and bridge are games that fall in this category, for example. Other kinds of games lack both skill and competitive purpose, but are nevertheless enjoyable. Rather than satisfy competitive urges, they instead provide satisfaction from the standpoint that they offer the thrill of winning, or success, but in a noncompetitive manner. Solitaire, games of random chance, such as bingo, or playing lottery numbers, for example, are particularly notable in this regard.

The invention disclosed here is best described as falling in the latter category. That is to say, it is a novelty device that can be used for non-competitive relaxation, and as a way of randomly selecting lottery numbers, bingo cards and horsebetting numbers, or the like. How the invention accomplishes this is described below.

SUMMARY OF THE INVENTION

The invention is a methodology device that can be used for relaxation, fortune telling, and the selection of gaming numbers. It comprises, in combination, a board surface that bears a plurality of individual numbers arranged, or arrayed, in a first circular field. Inside such field are a plurality of four mandala designs. One of such designs is positioned northerly with respect to the others, while the second, third and fourth designs are respectively positioned southerly, westerly and easterly with respect to the others.

A shirikin device is laid across the board surface, within the radius of the first numerical field just described. After the user goes through a selected pattern of preparatory activity, utilizing the mandala designs, whereby such activity is designed to place him or her into a state of relaxation, the user then places his or her hands upon the shirikin.

The shirikin is essentially a pointer device having a plurality of indicator arrows or pointers for directing the user's attention to certain ones of the numbers in the circular field. Upon placement of the hands on the shirikin, its pointers will be randomly moved to indicate certain numbers of the field, and the user may chose to utilize them when selecting the numbers on lottery tickets, for example, or for betting on horse races, or for fortune telling.

The mandala designs are chosen in accordance with certain universal symbols. By way of example, it is preferred that the northerly mandala be a vortex symbol, and the southerly mandala be a yin and yang symbol. The westerly and easterly mandalas are preferably octave and Arabic OM symbols, respectively.

In accordance with the invention, a ring field setting forth hexagrams of the Chinese I-Ching is positioned radially outwardly of the first circular field of numbers just described. Along with pointing to various numbers in the first circular field, the pointers of the shirikin will also indicate various hexagrams of the I-Ching, which can be used for fortune-telling purposes by those familiar with the philosophy and methodology of the same.

A second circular field of numbers is further positioned radially outwardly of both the I-Ching field and the first circular field of numbers. This field has alternating odd and even numbers, and alternating colors that correspond to the odd and even numbers. Like the first field, the second field may be used for selection of lottery numbers or other numbers consistent with either gaming or fortune telling.

Given the above summary of the methodology device in accordance with the invention, the invention will become better understood upon consideration of the following description which is intended to be taken in conjunction with the appended drawings.

BRIEF DESCRIPTION OF THE DRAWINGS

In the drawings, like reference numerals, numbers and symbols indicate like parts throughout the various views, unless indicated otherwise, and wherein.

BEST MODE FOR CARRYING OUT THE INVENTION

Figure 1:
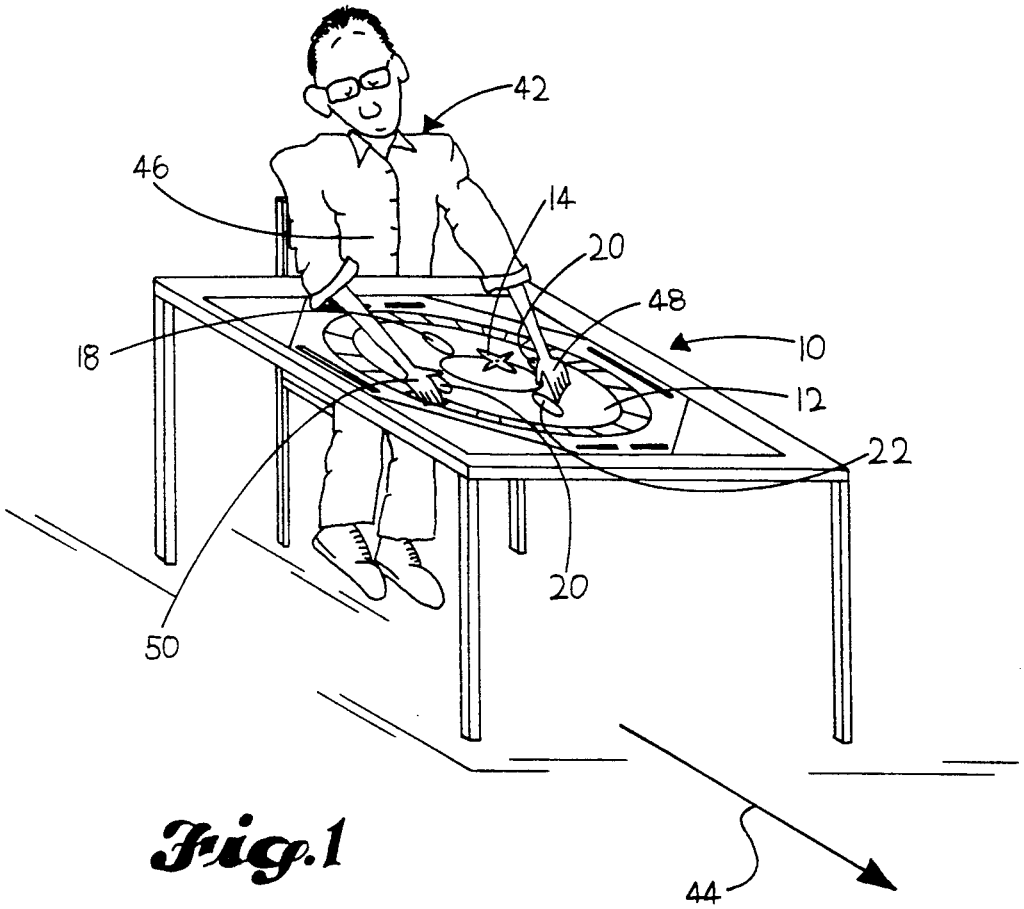
FIG. 1 is a pictorial view of a methodology device in accordance with the invention, and shows the device in use while placed flatly upon a table surface.
Figure 2:
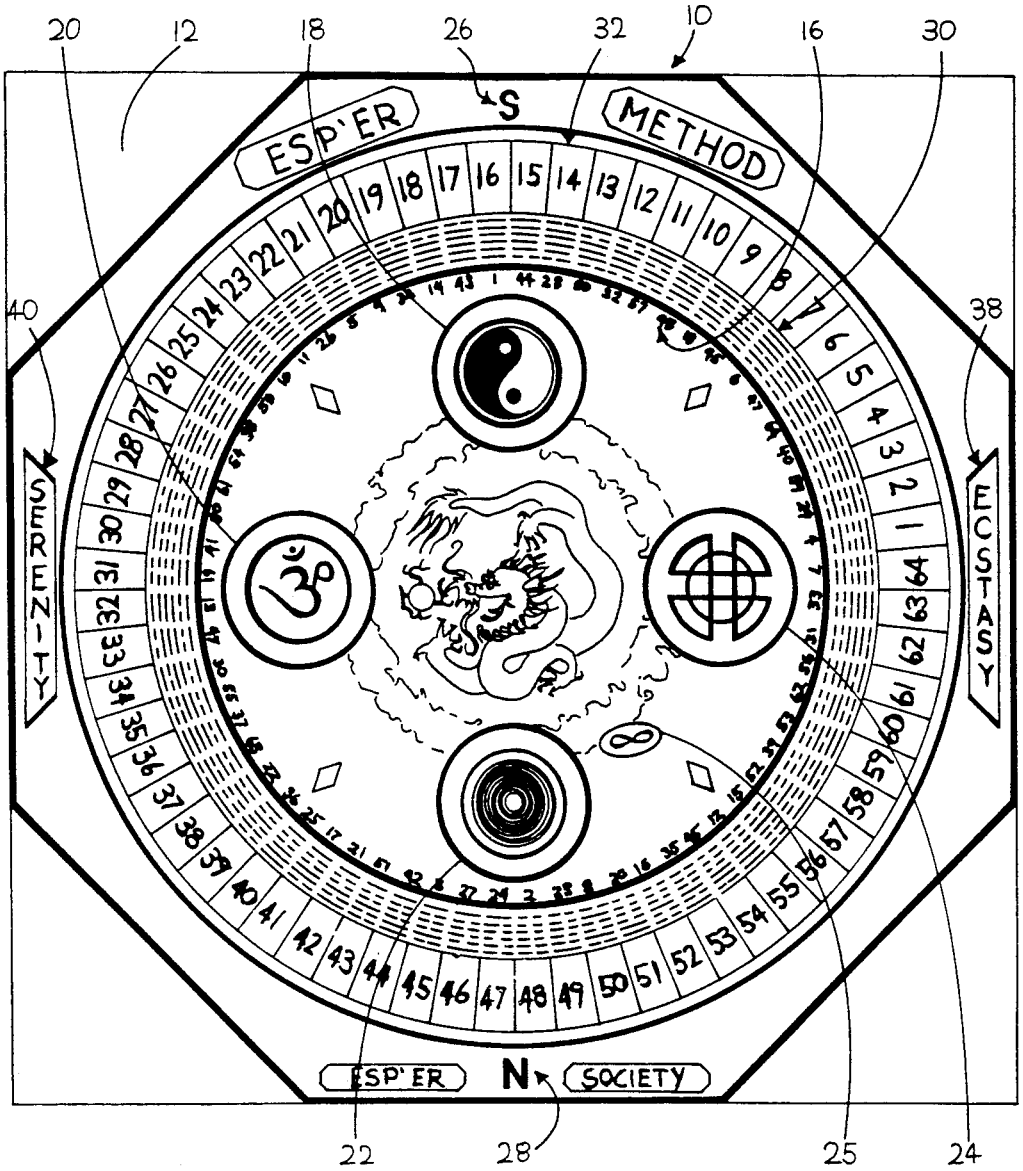
FIG. 2 is a top plan view of a board surface portion of the methodology device shown in FIG. 1.
Figure 3:
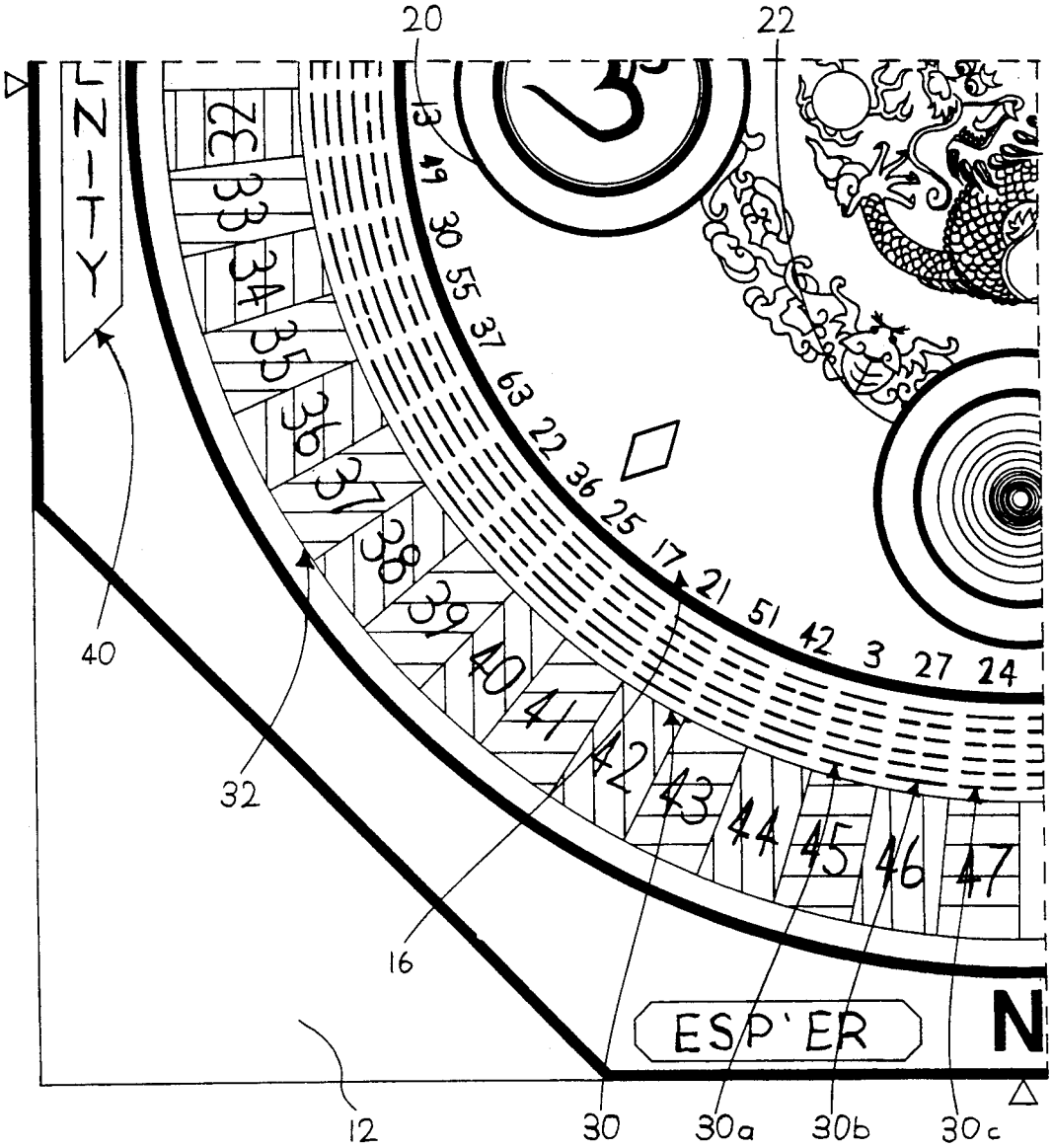
FIG. 3 is an enlarged fragmentary view of the lower, left-hand corner of the board surface portion shown in FIG. 2.
Figure 4:
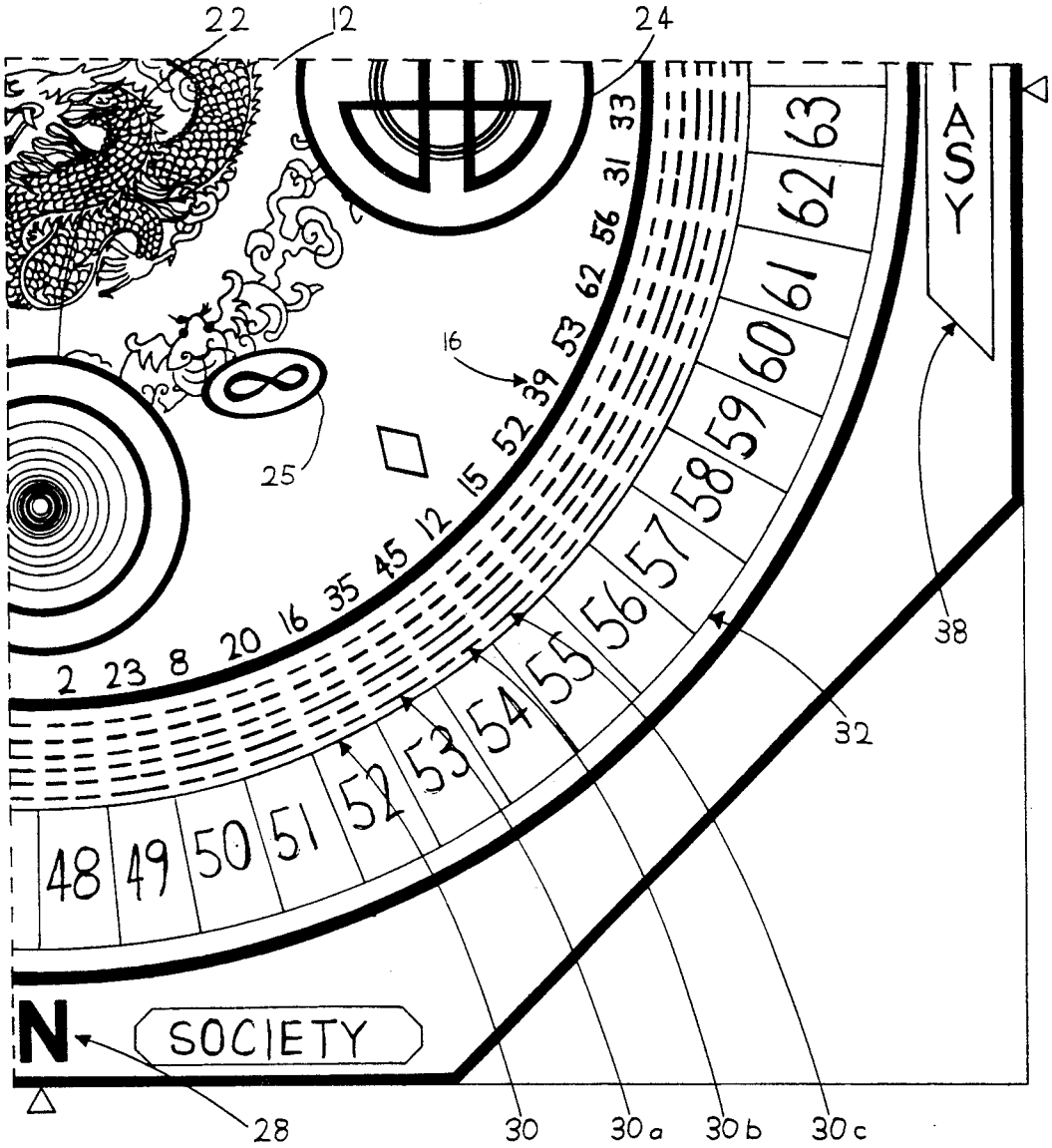
FIG. 4 is a view like FIG. 3 but shows the lower right-hand corner of the board surface portion.
Figure 5:
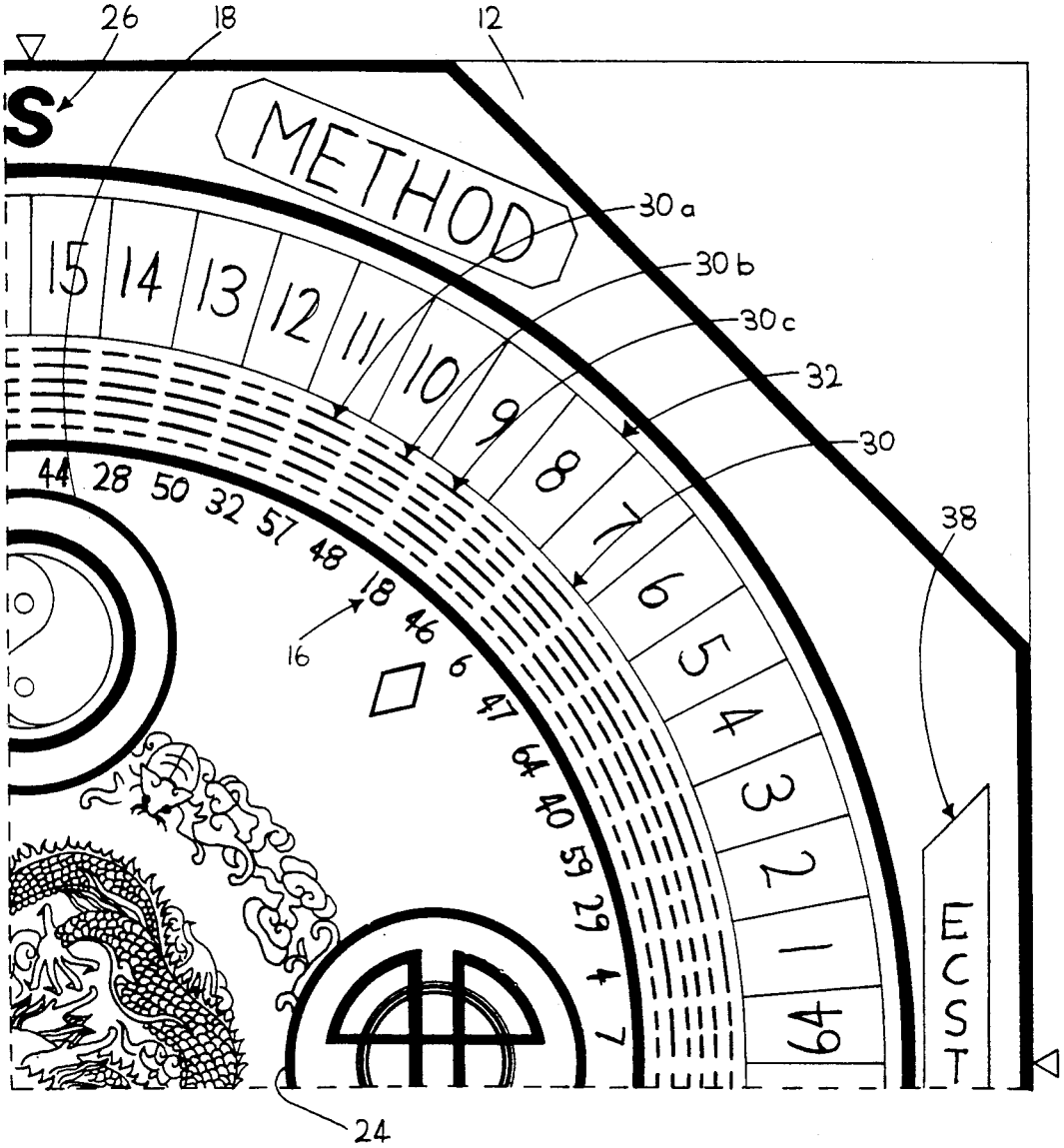
FIG. 5 is a view like FIGS. 3 and 4, but shows the upper right-hand surface of the board surface portion.
Figure 6:
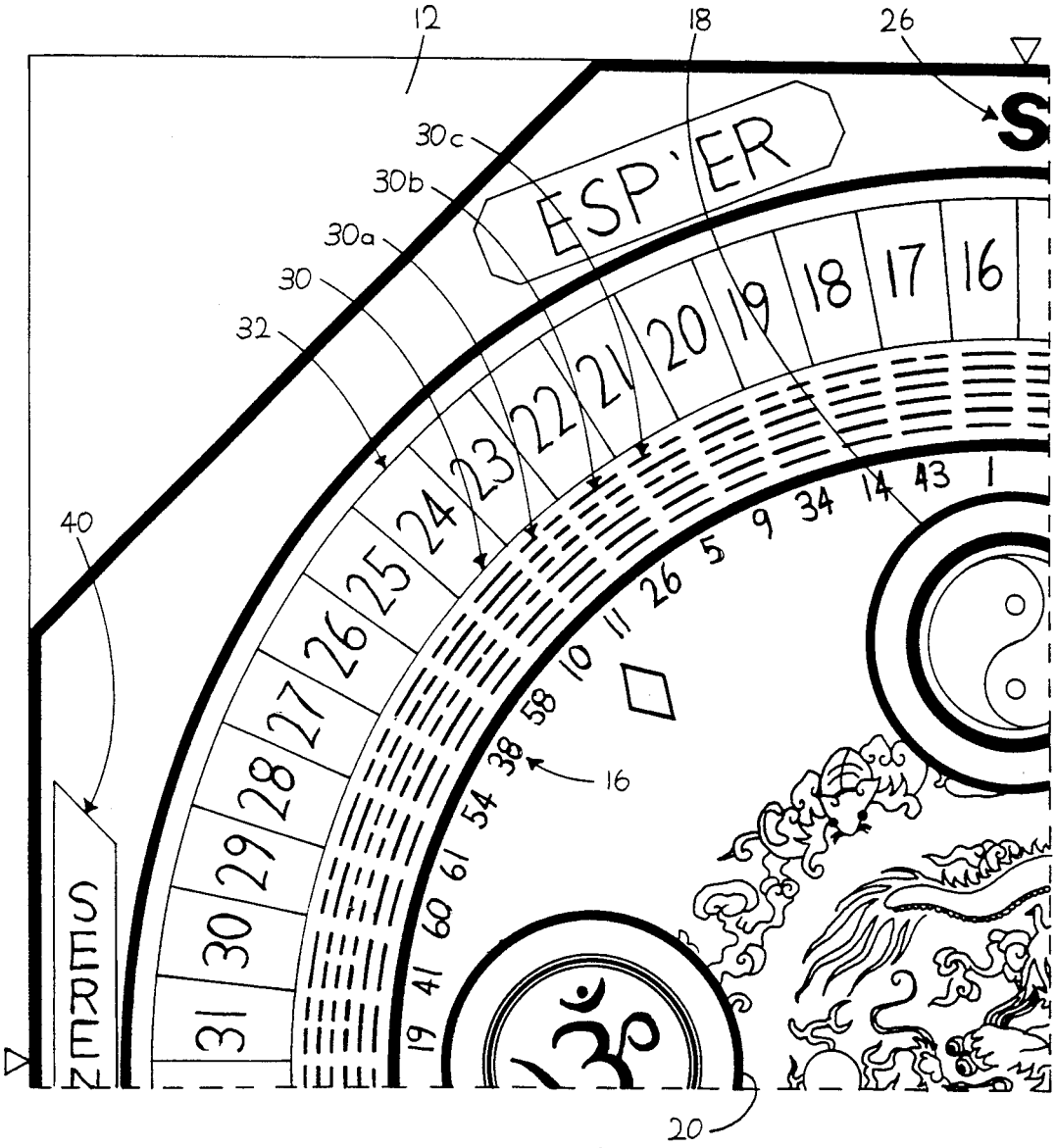
FIG. 6 is a view like FIGS. 3–5, but shows the upper left-hand corner of the board surface portion.

Referring now to the drawings, and first to FIG. 1, shown generally at 10 is a methodology device in accordance with the invention. The device 10 includes a board surface or board 12, and a shirikin device 14.

The board 12 is better seen in FIGS. 2–6. It has a first circular array, or field, of numbers, which are generally indicated at 16. This array or field 16 includes numbers from one to sixty-four, although they are not sequentially arranged. Positioned within such field 16 are four mandala designs 18, 20, 22, 24.

The board 12 has southerly and northerly directional indicators, which are shown at 26 and 28, respectively. These indicators orient the board so that it may be aligned generally parallel with the earth's axis of rotation, one end 26 pointing toward the earth's South Pole, and the other end 28 pointing toward the North Pole.

In accordance with such directional convention, the mandala design indicated at 22 shall be referred to herein as a northerly mandala, and the mandala design at 18 shall be referred to as a southerly mandala. Mandala designs 20, 24 shall respectively be referred to as easterly and westerly mandalas. The board 12 also bears an infinity symbol 25, which is positioned intermediate of the northerly and westerly mandalas 22, 24.

The reader should bear in mind that the easterly and westerly directions seem reversed in the drawings from the normal convention, or at least from the typical directional convention used when viewing maps or globes. The reason for this is that the northerly direction is indicated at the bottom in FIG. 2, while the southerly direction is indicated at the top. When viewing a map, for example, such directions would be reversed.

Positioned radially outwardly of the first numerical field 16 is a ring field of the Chinese I-Ching 30. The I-Ching field 30 is comprised of a plurality of I-Ching hexagrams 30*a*, 30*b*, 30*c* (see FIGS. 3–6), and is derived from Eastern religion. A person familiar with Eastern religion would recognize the I-Ching as being symbolic of the great wealth and uplifting values associated with taking a positive spiritual path, albeit one that is constantly surrounded by the negative obstacles that are forever found in life The hexagrams 30*a*, 30*b*, 30*c* of the I-Ching field may be given interpretation by those who are familiar with the study of I-Ching.

Positioned outwardly of the I-Ching ring field 30 is a second circular field, or array of numbers, indicated generally at 32. This second field 32 consists of alternating odd and even numbers, and like the first field 16, includes numbers from one to sixty-four. Unlike the first field 16, however, the numbers are sequentially arranged. The odd numbers are preferably displayed on a black background, as shown at 34 in FIG. 5, and the even numbers are preferably displayed on a red field, as shown at 36. This creates an alternating pattern of red and black colors along the circumference of the second field 32. Because the drawings are done in black and white, the color "black" is indicated with horizontal cross-hatching in FIG. 3. The color red is indicated with vertical cross-hatching in the same figure. No cross-hatching is shown in FIG. 2 or FIGS. 4–6, although it is to be understood that the colors of the second field 32 shown there, would alternate in the manner just described.

On the right-hand, or westerly, side of the board 12 is an icon, indicated generally at 38, which indicates spiritual ecstacy. On the left-hand, or easterly, side of the board 12 is another icon 40 which indicates spiritual serenity. Both of these icons 38. 40 are further described below.

Referring again to FIG. 1, a user 42 of the device 10 first arranges himself so that he (or she) faces south, as indicated by arrow 44. The board 12 is correspondingly aligned on a table 45 so that its southerly end 26 (see FIG. 2) also faces in the same direction. This means that the northerly end 28 is positioned near the torso 46 of the user 42 (see FIG. 1). Thereafter, the user 42 goes through the below-described pattern of actions or behavior designed to encourage relaxation and a heightened sense of awareness and/or perception.

After getting into the appropriate position, the user 42 first glances at the southerly mandala 18. A person familiar with Eastern spirituality would recognize such mandala as symbolizing the yin and yang, yin being negative and black, while yang being positive and preferably colored a strong red. Conventionally, yin and yang can be used to denote male-female roles, yes-no roles, or good-evil roles. The user 42 first glances quickly at the yin-yang mandala 18, and depending which color he sees first, i.e. red or black, is provided with an indicator of positivity or negativity.

Next, the user places his left hand 48 over the eastern mandala 20. In preferred form, the easterly mandala 20 is the Arabic symbol for OM (pronounced A-ohmmmmmmm). A person familiar with Eastern or Middle Eastern spiritual thought would recognize the easterly mandala 20 as symbolizing the embryonic heartbeat that emanates from the womb of the universe, or otherwise symbolizes the sound of the universe. In order to promote relaxation, the user 42 should intone this sound after placing his left hand 48 over the symbol.

Thereafter, the user 42 should place his right hand 50 over the westerly mandala 24, which is preferably an octave symbol. Once again, a person familiar with Eastern spirituality would recognize such mandala as symbolizing the energy of the universe, or the epitome of universal energy.

After placement of the hands 48, 50 in the above-described fashion, the user 42 then gazes directly at the northerly mandala 22, which is a vortex symbol. Such symbol functions, in Eastern thought, as a mind-clearing symbol. In other words, Eastern spirituality dictates that the purpose of gazing at such symbol is to clear the mind and encourage relaxation. Thereafter, to finish the relaxation period, the user's gaze should gently shift to the infinity symbol 25 (see FIG. 2) that is located between the vortex and octave mandalas 22, 24.

Figure 7:
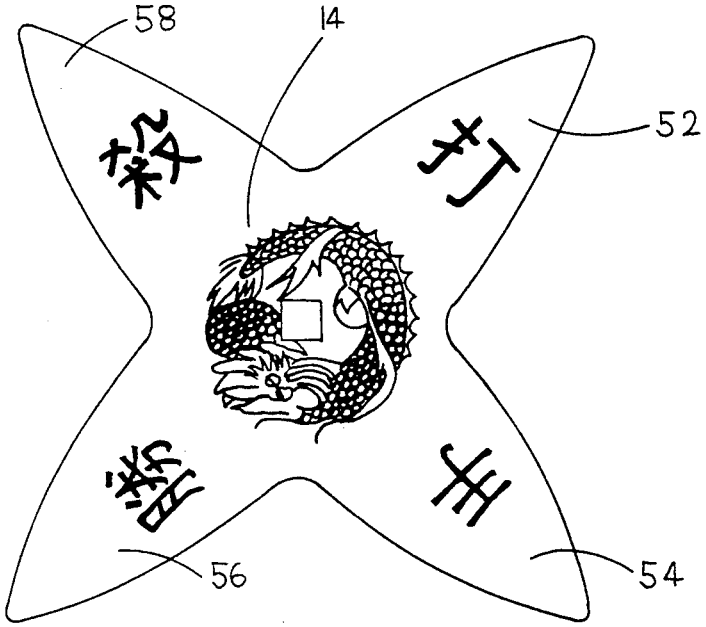
FIG. 7 is a top plan view of a shirikin device that is used in combination with the board surface portion shown in FIGS. 2–6.

After finishing the above-described relaxation pattern, the user 42 then places his hands 48, 50 on the shirikin 14 which is resting flatly on the board surface 12 somewhere between the mandalas 18, 20, 22, 24. As shown in FIG. 7, the shirikin 14 has a plurality of pointers 52, 54, 56, 58. Placement of the user's hands 48, 50 on the shirikin causes its pointers 52, 54, 56, 58 to be directed to certain ones of the numbers in the first numerical field 16, or to the hexagrams 30*a*, 30*b*, 30*c* of the I-Ching in the ring field 30, or to certain other numbers in the second numerical field 32. The user can thereby use such numbers and hexagrams to select lottery numbers, or horse racing numbers, or to tell fortunes, and the like. After such selections are made, the user then allows the shirikin 14 to move off the board 12, either to his left or right. If left, the shirikin will cross the serenity icon 40, and if right, the shirikin will cross the ecstacy icon 38, which respectively indicate a sense of relaxation or pleasure.

The invention described above should be viewed as a novelty item. The preceding description should be taken as the best description of the device 10 as it is presently known. However, it is to be understood that certain changes could be made to the device 10 without departing from what is considered to be the spirit and scope of the invention. For this reason, anything stated above should not be construed in the limiting sense, but instead, the patent claims which follow should be viewed as defining the limits of patent protection.

What is claimed is:

1. A methodology device for use in selecting gaming numbers, comprising:

a surface bearing a plurality of individual numbers arranged in a first circular field;

a plurality of four mandala designs positioned on said surface inside said circular field, one of said mandala designs being positioned northerly with respect to the others, and a second one of said mandala designs being positioned southerly with respect to the others, and a third one of said mandala designs being positioned westerly with respect to the others, and the fourth mandala being positioned easterly with respect to the others; and a shirikin device adapted to be laid flatly on said surface within said circular field, said shirikin device having a plurality of pointers for directing a user's attention to certain numbers of said field.

2. The methodology device of claim 1, further including a ring field of the I-Ching, positioned radially outwardly of said first circular field.

3. The methodology device of claim 2, including a second circular field of individual numbers positioned radially outwardly of said I-Ching field, said second field having alternating odd and even numbers, and having alternating colors corresponding to said odd and even numbers.

4. The methodology device of claim 3, including an ecstacy icon positioned outwardly of said second field and easterly of said mandala designs.

5. The methodology device of claim 3, including a serenity indicator positioned outwardly of said second field, but adjacent said westerly mandala.

6. The methodology device of claim 1, wherein said northerly mandala design comprises a vortex symbol.

7. The methodology device of claim 1, wherein said southerly mandala design comprises a yin and yang symbol.

8. The methodology device of claim 1, wherein said easterly mandala design comprises an Arabic OM symbol.

9. The methodology device of claim 1, wherein said westerly mandala design comprises an octave symbol.

10. The methodology device of claim 1, including an infinity symbol positioned inside of said first circular field.

11. The methodology device of claim 10, wherein said infinity symbol is positioned intermediately of said northerly and westerly mandala designs.

12. The methodology device for use in selecting gaming number, comprising:

a surface bearing a plurality of individual numbers arranged in a first circular field;

a plurality of four mandala designs positioned on said surface inside said circular field one of said mandala designs being positioned northerly with respect to the others, and a second one of sand mandala designs being positioned southerly with respect to the others, and a third one of said mandala designs being positioned westerly with respect to the others, and the fourth mandala being positioned easterly with respect to the others;

a ring field of the I-Ching, positioned radially outwardly of said first circular field;

a second circular field of individual numbers positioned radially outwardly of said I-Ching field, said second field having alternating odd and even numbers, and having alternating colors corresponding to said odd and even numbers;

an ecstacy icon positioned outwardly of said second field and easterly of said mandala design;

a serenity indicator positioned outwardly of said second field, but adjacent said westerly mandala;

an infinity symbol positioned intermediately of said northerly and westerly mandala designs and positioned inside said first circular field; and a shirikin device adapted to be laid flatly on said surface within said circular field, said shirikin device having a plurality of pointers for directing a user's attention to certain numbers of said field;

wherein said northerly mandala design comprises a vortex symbol;

wherein said southerly mandala design comprises a yin and yang symbol;

wherein said easterly mandala design comprises an Arabic OM symbol;

wherein said westerly mandala design comprises an octave symbol.

* * * * *

UNITED STATES PATENT AND TRADEMARK OFFICE

CERTIFICATE OF CORRECTION

PATENT NO. : 5,203,564

DATED : April 20, 1993

INVENTOR(S) : Carl J. Bruzas and Bryant V. Rutherford

It is certified that error appears in the above-identified patent and that said Letters Patent is hereby corrected as shown below:

Column 1, line 20, "Primative" should be -- primative --.

Column 3, line 47, should be a period (.) after "life"

Column 4, line 5, "38. 40" should be -- 38, 40 --.

Claim 12, column 6, line 22, "sand" should be -- said --.

Signed and Sealed this

Twenty-second Day of March, 1994

*Attest:*

Bruce Lehman

BRUCE LEHMAN

*Attesting Officer*

*Commissioner of Patents and Trademarks*